US009127412B2

(12) United States Patent
Spurlock et al.

(10) Patent No.: US 9,127,412 B2
(45) Date of Patent: Sep. 8, 2015

(54) RAILCAR BALLAST DISTRIBUTING APPARATUS

(71) Applicant: Montana Hydraulics, LLC, Helena, MT (US)

(72) Inventors: Andrew J. Spurlock, Baldwin City, KS (US); Edward A. Burris, Lawrence, KS (US); Daniel P. Hartness, Lawrence, KS (US)

(73) Assignee: MONTANA HYDRAULICS, LLC, Helena, MT (US)

( * ) Notice: Subject to any disclaimer, the term of this patent is extended or adjusted under 35 U.S.C. 154(b) by 0 days.

(21) Appl. No.: 14/296,064

(22) Filed: Jun. 4, 2014

(65) Prior Publication Data

US 2014/0360056 A1 Dec. 11, 2014

Related U.S. Application Data

(60) Provisional application No. 61/956,386, filed on Jun. 7, 2013.

(51) Int. Cl.

| | |
|---|---|
| ***E01B 27/02*** | (2006.01) |
| ***B61D 15/00*** | (2006.01) |
| ***B61D 7/02*** | (2006.01) |
| ***B61D 7/32*** | (2006.01) |

(52) U.S. Cl.

CPC ..... *E01B 27/025* (2013.01); *B61D 7/02* (2013.01); *B61D 7/32* (2013.01); *B61D 15/00* (2013.01); *E01B 27/022* (2013.01)

(58) Field of Classification Search

USPC ..... 37/104, 214, 217; 105/254

IPC ..... E01B 27/022,27/025; E01D 15/00

See application file for complete search history.

(56) References Cited

U.S. PATENT DOCUMENTS

| | | | | |
|---|---|---|---|---|
| 373,907 | A | | 11/1887 | Rodger |
| 1,232,748 | A | | 7/1917 | Allen |
| 1,418,402 | A | | 6/1922 | Scott |
| 2,989,930 | A | | 6/1961 | Flowers |
| 3,394,663 | A | * | 7/1968 | Bryan, Jr. ..... 105/239 |
| 3,605,297 | A | * | 9/1971 | Kershaw ..... 37/105 |
| 3,677,191 | A | | 7/1972 | Nagy |
| 4,249,325 | A | | 2/1981 | Theurer |
| 4,266,351 | A | | 5/1981 | Cox |
| 4,266,353 | A | | 5/1981 | Newman |
| 5,579,593 | A | | 12/1996 | Murray |
| RE36,685 | E | | 5/2000 | Bounds |
| D638,751 | S | | 5/2011 | Aaron et al. |
| 2012/0110877 | A1 | | 5/2012 | Theurer et al. |

* cited by examiner

*Primary Examiner* — Gary Hartmann

(57) ABSTRACT

This invention may comprise a railcar ballast distributing apparatus comprising a ballast railcar traveling in a direction of travel on a pair of railroad rails, a plow mechanism operatively attaching to a main bracket assembly attaching to the middle underside of the railcar, and being powered by a hydraulic system, the plow mechanism comprising: a spring box assembly mechanism operating a single plow blade assembly comprising: a pair of articulating and independently movable plow blades vertically and independently adaptable during contact against the pair of railroad rails and having a transport mode span and a separate deployed mode span, and a spring-loaded safety locking latch mechanism, the spring box assembly mechanism vertically deploying and retracting the pair of plow blades, which automatically and differentially change orientation when contacting the pair of railroad rails, and increase to the deployed mode span and decrease to the transport mode span.

12 Claims, 9 Drawing Sheets

SECTION "C-C"

SECTION "B-B"

DETAIL "C"

DETAIL "D"

SECTION "D-D"

RAILCAR BALLAST DISTRIBUTING APPARATUS

This application claims priority from the provisional patent application filed Jun. 7, 2013, Application No. 61/956,386.

FIELD OF INVENTION

This apparatus of the present invention relates to a ballast distributing apparatus, providing a bi-direction plow assembly; a piece of equipment that can be utilized to screet-off ballast that is applied to railbeds, attaching to existing rail cars without causing operational interference or decreasing strength or function of said apparatus.

BACKGROUND

Rail cars that dump rock, pebble and/or gravel, or ballast rock, need a way to spread the ballast. Ballast car plows are found and used in the railroad industry, particularly in the "Maintenance of Way" division of a railroad. Along railroad tracks, ballast, is dumped where it will pile above the top of railroad track rails, particularly during railroad track maintenance and new construction. Optimal railroad track conditions depend on ballast distribution and maintenance. Prior to the invention, the only option was a plow mounted on the front end of a rail car, and the only way the ballast could be spread out with current technology would be where the rail car is traveling in one direction. The embodiment of the present invention is the only bi-directional ballast rock plow known in the industry. The industry needs a more efficient and cost-effectiveness means of placing ballast on railroad tracks.

Screeting, or shedding, rail ballast away from, and even with, the top of rails after being dumped out of ballast rail cars, and in either direction of rail car movement, are desired features for distributing ballast. Rock to a railroad bed should be moved in such a fashion to fill the crib level (the level of the space between the rails) to the top of a rail and move access rock far enough away from the center of the railroad track to allow other railroad equipment to follow and work without coming in contact with ballast. A plow needs to be mounted directly to existing ballast rail cars and utilize existing power currently used in operating the railcar ballast gates to extend and retract, or move vertically up, from their working position to their travel position under the ballast car.

The invention includes a plow designed to screet off ballast to a level dumped between the rails even with the top of the rails, along a railroad track. The bi-directional ballast plow is designed to be mounted to automated ballast rail cars. This invention is mounted under the rail car, on the rail car sill, in the center of the car. The blades of the plow have independent, articulating action, whereby each blade can move in the direction, moving side-to-side, necessary for the way the rock is stockpiled and the direction the rail car is moving. The blades articulate or pivot in a diagonal position in response to the direction of the rail car, yielding to the resistance of the ballast rock. The articulating blades move the ballast rock away from crib due to the diagonal, pivoted position of the blades. When the rail car reverses course, the blades again articulate or pivot in a diagonal position in response to the new direction of the rail car, yielding to the resistant of the ballast rock. Therefore, the direction of the rail car does not have to change in order to effectively plow the ballast.

Other ballast plow inventions have used two plows per car to plow ballast rock in either direction. With the preferred embodiment of the present invention, only one plow per car is required to screet ballast in either direction with the ballast plow. U.S. Pat. No. Re. 36.685 to Bounds ("Bounds"), U.S. Pat. No. 5,579,593 to Murray ("Murray") and U.S. Pat. No. D638,751 S to Aaron, et al. ("Aaron") all disclose plow blades which are fixed or static and non-articulating, and when raised for travel will fit within the guidelines of the Association of American Railroads ("AAR") Plate C envelope (as described below), but which could not fit within the AAR requirements and at the same time have the same width for distributing ballast, as the preferred embodiment of the present invention.

None of the references of related art teach the invention as disclosed herein. None teach the use of a pair of independently movable blades for the plow member. The pairs of plow blades taught in the ballast plows of Murray. Bounds and Aaron are fixed and not independently movable. U.S. Pat. No. 3,605,297 to Kershaw ("Kershaw") appears to teach a pair of interconnected articulating pair of plow blades (#80, #81) but the device is not for mounting to the underside of a railcar. U.S. Pat. No. 4,266,351 to Cox and U.S. Pat. No. 4,266,353 to Newman also appear to teach independently movable plow blades (#30 in each) but they are also not attached to the underside of a railcar. U.S. Patent Application #2012/0110877 to Theurer ("Theurer") et al. teaches a vertically adjustable plow, however it does not appear to disclose a pair of blades that are independently articulated (FIG. 1).

Although the related art references all relate to ballast plows and several appear to disclose independently movable plow blades, operable in either direction of railcar movement and hydraulic means for directly lifting the blades, none of the references teach the spring box mechanism of the preferred embodiment of the present invention which allows the proposed blades to pivot independent of each other including a float spring for controlling pressure of the blade against the rail.

The invention is designed for increased safety and efficiency when distributing ballast, and operates to effectively screet in either direction that the rail car, to which the apparatus invention is attached, is moving. The apparatus has the ability to operate in either direction of rail car movement without the need for an operator to physically adjust the direction or position of the blades.

Critical to any functioning rail car ballast plow is to operate within the Association of American Railroads (AAR) railroad standard "AAR Plate C envelope". The bi-directional plow when deployed in the down, or employed position, against the rails, is of one width (the standard is 9'6" wide), yet when it is in the up, or retracted, position for transport is necessarily in a smaller width (the standard is 8'4½"), allowing it to fit in the AAR Plate C envelope. Other inventions in the related art have a fixed plow width within which to attempt to operate in the same manner as the embodiment of the present invention. However, the invention, the plow, lays rock, fills in the crib and moves access rock outside of the rails, beyond a standard railroad width (to as much as 9 foot 6 inches and not to exceed ten (10) feet). The plow allows for cross-level and maintains constant contact with the top of the rails. This allows for rail tamping by other equipment, without the use of regulating or ballast clearing equipment required by other plows in the industry.

The aforementioned patents do not disclose the safety locking latch mechanism of an embodiment of the present invention, operating with a hydraulic valve, and a dual spring and gravity return mechanism. Locking mechanisms in the related art, including the Bound and Murray patents use chain supported latch return mechanisms. The plow of the preferred embodiment of the present invention can be activated and operated from either side of the ballast our and does not require operators to be located simultaneously on each side of the car as in the related art.

There is no known technology, or related art, providing the same or similar results. Applicant knows of no other center-mounted articulating railroad plows in operation. There are currently only non-articulating rail fixed plows operating in the industry that are mounted on the ends or center of rail cars.

SUMMARY

The preferred embodiment of the present invention discloses new elements providing the improvements demonstrated therein. Previous ballast distribution cars which have plows mounted for the purpose of distributing and leveling the ballast to the top of the rails utilized two separate plows in order to screet ballast in either direction of railcar movement. The invention, the bi-directions plow, requires only one plow to screet ballast in either direction of car movement with the use of articulating blades. Other plow designs use multiple linkages to facilitate the raising and lowering of the plows through the use of hydraulic cylinders. The invention, the bi-directional plow, utilizes hydraulic cylinders which are directly attached to the plow assembly to raise and lower the plow without any linkage assembly. A flow divider is also employed to facilitate smooth raising and lowering of the plow.

The invention therefore is directed to a ballast plow for distributing and leveling ballast that has been dumped in front of it and between the rails. The apparatus employs a pair of plow blades that maintain contact with the rails as the railcar moves along the rails or to plow or otherwise level the ballast. The apparatus functions when the railcar is moving in either direction (direction of travel) due to the use of a single blade plow assembly having a pair of articulating blades with a blade width that increases upon deployment (deployed mode span) and decreases when retracted (transport mode span). The articulating blades are adapted to automatically change direction with the direction of the railcar (direction of travel) since the blades are guided against the rails due to frictional contact. The apparatus further comprises a main bracket assembly to attach the plow mechanism to the center sill of a railway car (ballast railcar). The spring box assembly mechanism enables the blades to be raised and lowered and about which to pivot and swing rearwardly relative to the direction of railcar travel. The plow blades or pair of wings, are attached to the spring box assembly mechanism and move independent of each other. A pivot tube assembly houses a float spring that vertically compresses so as to enable the plow mechanism to maintain constant pressure against the rails. A safety locking latch mechanism is provided on one side of the apparatus.

The invention apparatus can be deployed and stowed efficiently while fitting into given restricted rail operational tolerances. The invention will not allow excess rock to flow over the top and fall behind the leveled rock on the railbed. The apparatus maintains constant contact with the top of the rail and does not allow rock to build up under the apparatus and potentially cause railcar derailment. Said embodiment of the present invention, therefore, is safe to operate and efficient.

Previous plows have been a fixed width; however, this plow, in an embodiment of the invention, when deployed is one width (one standard is 9' 6" wide not to exceed 10'), and when raised in the transport position to a smaller width (a standard is 8' 4½" wide), which allows the plow to fit within the AAR Plate C envelope in the transport position while being mounted in the center of the car. Controls and a safety catch release located on either side of the ballast rail car in the embodiment allow a single person on either side of a ballast car to operate the plow. Another improvement of the invention is that the bi-directional movement allows the plow to be located in the center of the car and reduces the amount of valves, cylinders and controls required to operate the plow.

The plow of the invention fits existing railcars with a four or six hopper arrangement and discharges ballast either inside or outside the rail or both at the same time. The plow can be used with many hopper gate styles already existing or those that may be built in the future which discharge ballast on the inside or outside of the rail. Many of the existing railcars do not have the necessary clearance between the wheels (trucks) and ballast gates to accommodate a plow on either end of the car. Thus, a center mounted ballast plow as with the invention is needed in the industry to solve this problem.

Another improvement of the preferred embodiment of the present invention is its ability for the articulating blades to adjust vertically, independently of each other, to accommodate for differences in cross-level conditions.

Previous locking mechanisms on ballast plows utilized a "chain and hook" arrangement as a safety latching mechanism. This arrangement required a safety chain in each side of the car. During deployment, a person was required to un-hook the safety latch on each side of the car. The bi-directional plow latch of an embodiment of the present invention only requires one operator on one side of the car (either side) to unlock the safety latch, increasing railcar operating efficiency. When the plow is raised to the transport position, the latching mechanism engages automatically without the need for an operator to physically attach the latch.

The embodiments of the invention has the following additional advantages:

1. Single mounting location;
2. Articulating blades, each blade moving independently of the other, which change direction as the rail car changes direction and which can plow in either direction without the need for an operator to make an adjustment;
3. Ease of operation so that the plow can be deployed, retracted and stowed with a single operator on one side of the ballast car;
4. Ergonomic operating controls;
5. The ability for plows to be deployed and stowed while the train is in motion, eliminating the need to stop frequently to stow plows;
6. The ability to use a railcar's existing power supply; and
7. Eliminating the need for a regulator or a drag tie to operate behind the train, freeing the operator to operate equipment to perform other tasks.

Embodiments of the invention has the following additional improvements and advantages over the current railcar plows:

1. Modified system to allow blades to move independently;
2. Taller blades;
3. Faced blades with Formalloy 400, or other abrasion resistant alloy steel;
4. Faced diamond box with Formalloy 400, or other abrasion resistant alloy steel;
5. Bigger hydraulic cylinders;
6. Redesigned main side plow plate to lighten and to bolt to railcar;
7. Added safety latch to prevent plow from dropping in the event of hydraulic failure;
8. Modifications to result in better ability to shed rock;
9. Larger pivot tubes with strengthened blade mounting;
10. Wider blade footprint;
11. Cross braces between main side plates;

12. Improved mounting of blade retainers for easier manufacture and maintenance;
13. Strengthened blade stops on frame; and
14. Strengthened blade stops on blades.

The foregoing and other objectives, advantages, aspects, and features of the present invention will be more fully understood and appreciated by those skilled in the art upon consideration of the detailed description of a preferred embodiment, presented below in conjunction with the accompanying drawings. The aforementioned features, aspects and advantages of the present invention, and further objectives and advantages of the invention, will become apparent from a consideration of the drawings and ensuing description.

DRAWINGS

The foregoing features and other aspects of the present invention are explained and other features and objectives of the invention will become apparent in the following detailed descriptions, taken in conjunction with the accompanying drawings. However, the drawings are provided for purposes of illustration only, and are not intended as a definition of the limits of the invention.

FIGS. 1A and B are an elevated first, right side and front views, respectively, of the ballast rail car showing the plow blade assembly in retracted position, and alternative directions of travel of the ballast railcar, of an embodiment of the present invention. FIG. 1B depicts Section A-A from FIG. 1A. FIG. 1A includes Detail "C."

FIGS. 2A and B are elevated first, right side and front views, respectively, of an embodiment of the invention, showing the plow blade assembly in deployed position, of an embodiment of the present invention. FIG. 2B depicts Section B-B from FIG. 2A.

Figure 7A:
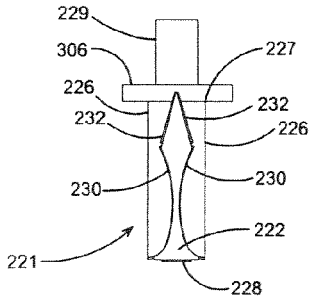
Figure 7B:
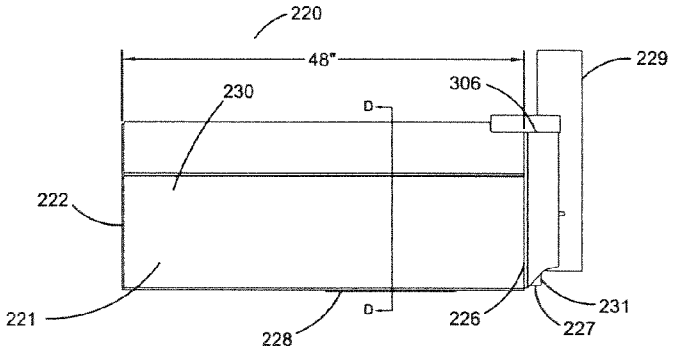
Figure 7C:
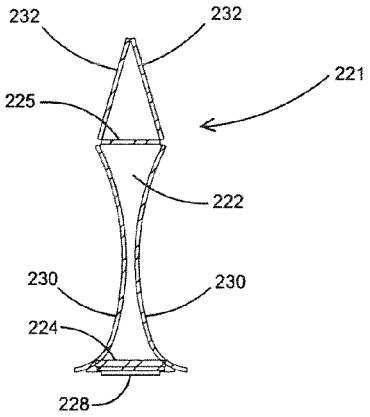

FIGS. 7A-C are elevational; end, side and sectional views, respectively, of the single plow blade assembly of an embodiment of the invention. FIG. 7C depicts Section D-D from FIG. 7B.

Figure 8A:
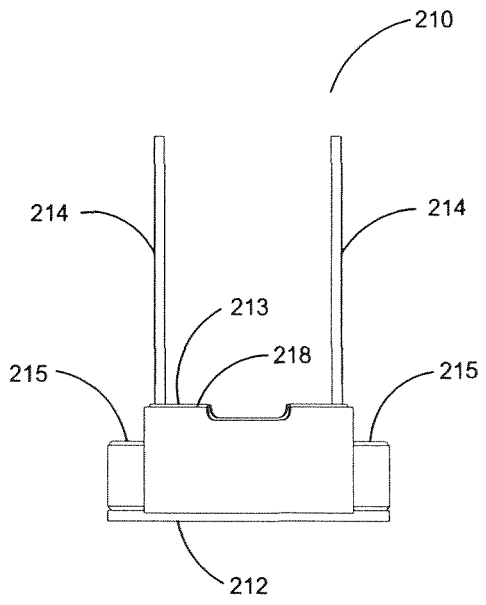

FIGS. 8A and B are elevated and planar views, respectively, of the spring box assembly mechanism of an embodiment of the invention.

Figure 4A:
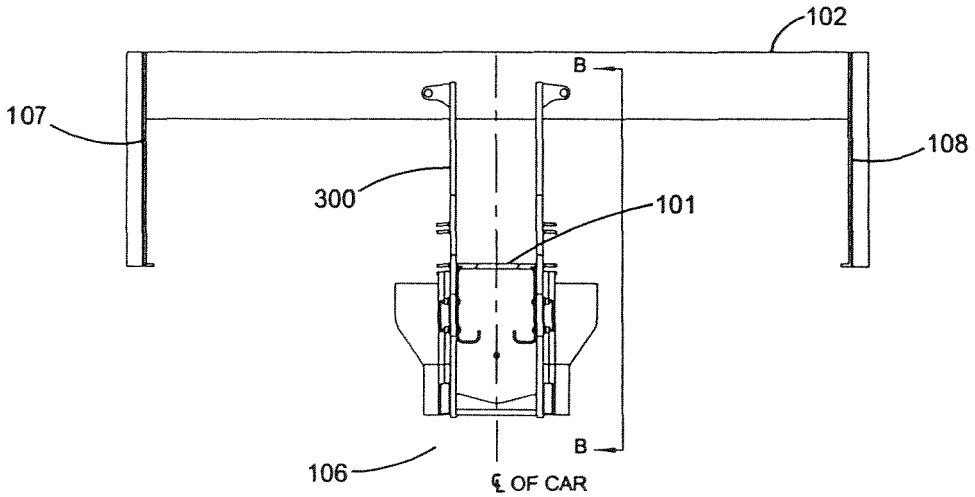
FIG. 4A is a back elevated view of Section C-C from FIG. 1A, of the main bracket assembly attached to the railcar of an embodiment of the invention.
Figure 4B:
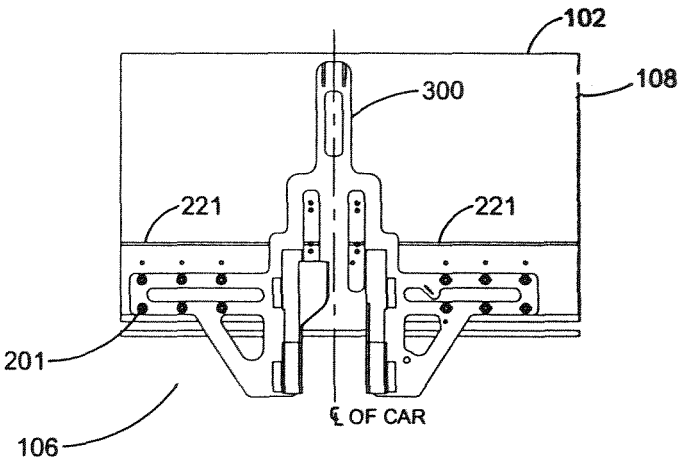
FIG. 4B is a second, left side, elevated view of Section B-B of FIG. 4A, of the main bracket assembly to the railcar of an embodiment of the invention.
Figure 9A:
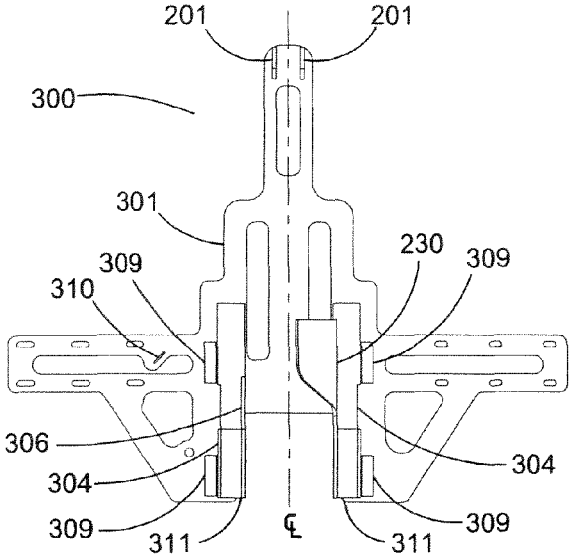

FIGS. 9A and B are elevated, blown up views FIG. 4B and of FIG. 4A, respectively, of the main bracket assembly of an embodiment of the invention.

Figure 9B:
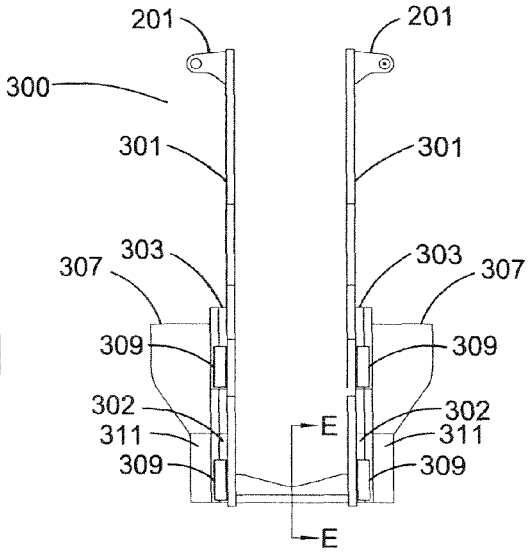
Figure 9C:
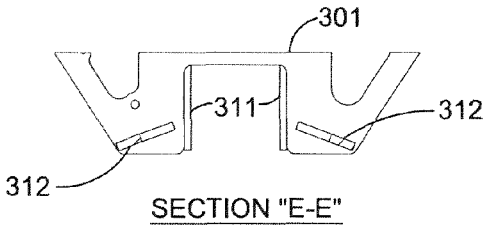

FIG. 9C is a partial elevated view of Section E-E from FIG. 9B, of an embodiment of the invention.

Figure 10:
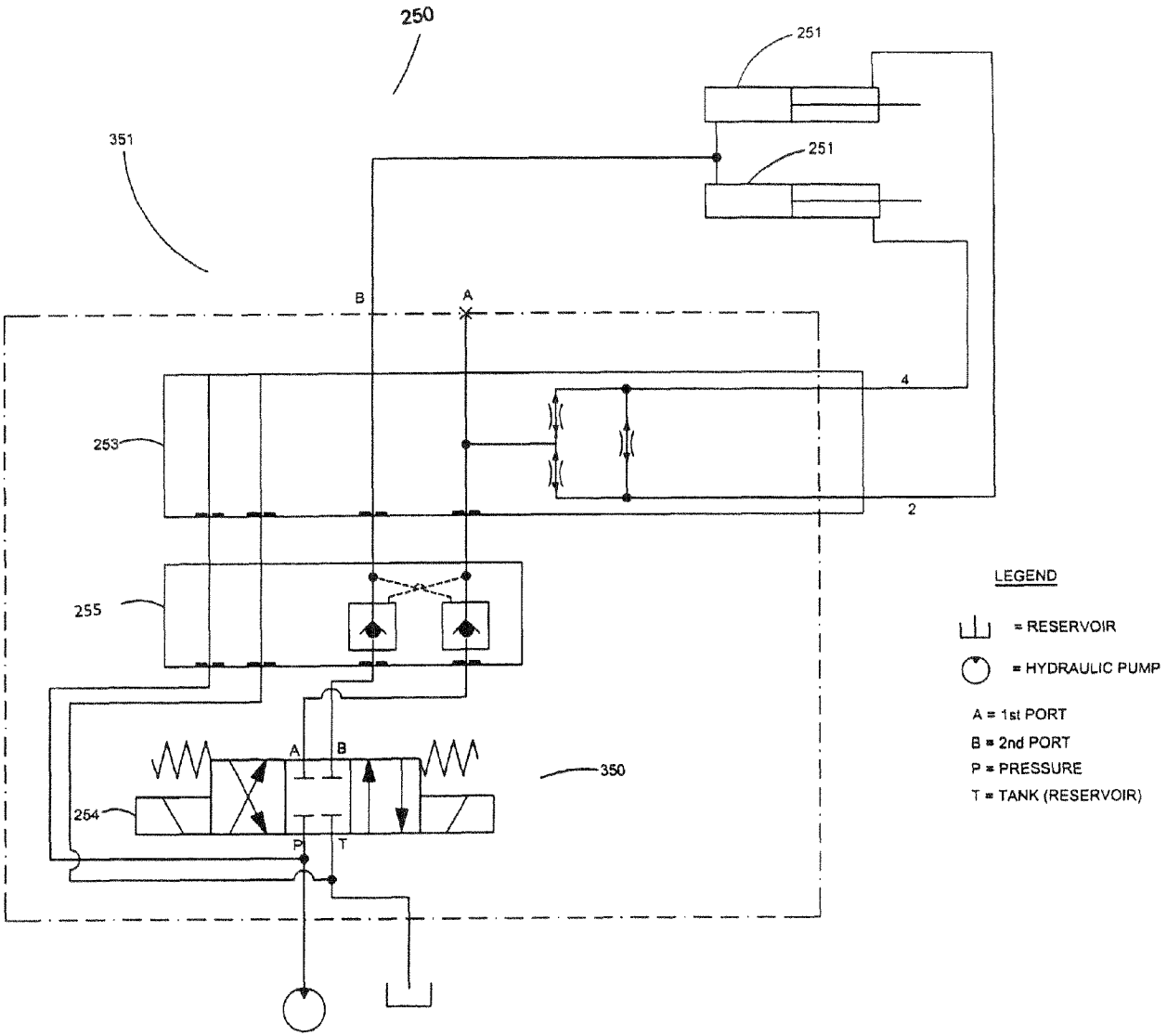

FIG. 10 is a schematic of the hydraulic system of an embodiment of the invention.

DETAILED DESCRIPTION

The present invention will now be described more fully hereinafter with references to the accompanying drawings, in which the preferred embodiment of the invention is shown. This invention may, however, be embodied in different forms, and should not be construed as limited to the embodiments set forth herein. Rather, the illustrative embodiments are provided so that this disclosure will be thorough and complete, and will fully convey the scope of the invention to those skilled in the art. It should be noted, and will be appreciated, that numerous variations may be made within the scope of this invention without departing from the principle of this invention and without sacrificing its chief advantages. Like numbers refer to like elements throughout.

Figure 1A:
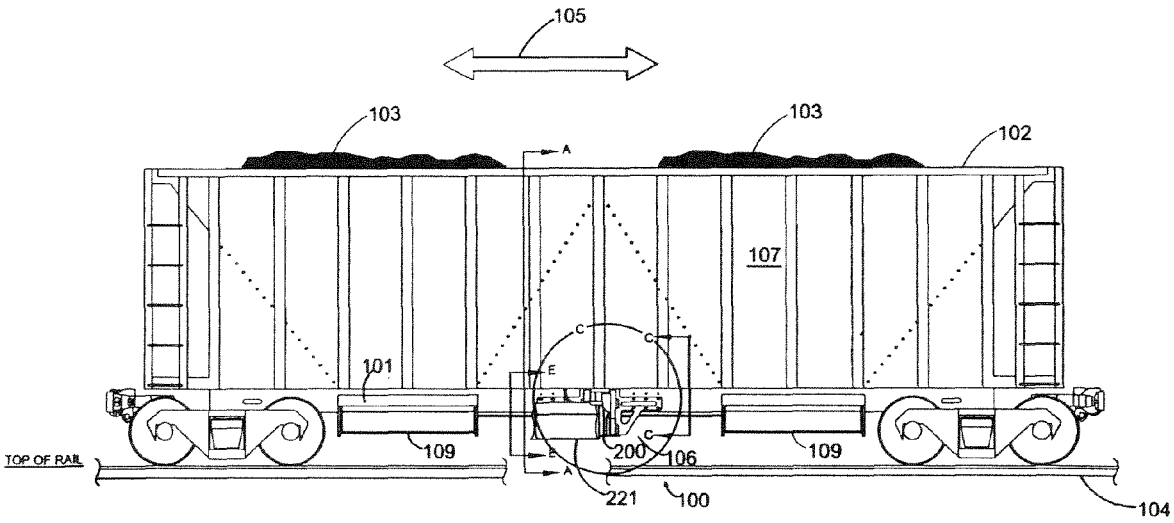

Turning to the figures, FIGS. 1 A and B and FIGS. 2 A and B of the invention illustrate a railcar ballast distributing apparatus 100, comprising a railroad ballast railcar 102, which further comprises: a first side 107, or right side, a second side 108, or left side, a middle underside 106, at least one hopper ballast release 109 and a center sill 101. FIG. 1A depicts the ballast railcar 102 loaded with ballast 103 on the railroad rails 104 having the apparatus ballast distributing apparatus 100, and a direction of travel 105 indicating the railcar 102 may travel in either direction (bi-directional) on the rails 104 distributing the ballast 103 on the rails 104. An embodiment of the present invention, the bi-directional ballast plow, is designed and intended to be mounted to automated ballast railcars. The purpose of the apparatus 100 invention is to screet the ballast 103 that is dumped between the rails 104 (the crib 110) and outside of the rails 104 to a level even with the top of the rails 104, with the ability of the railcar 102 to operate in either direction of travel 105 of the railcar 102 movement without the need for an operator to physically adjust the direction or position of the pair of articulating plow blades 221 to a plow mechanism 200 which distribute the ballast 103.

Figure 1B:
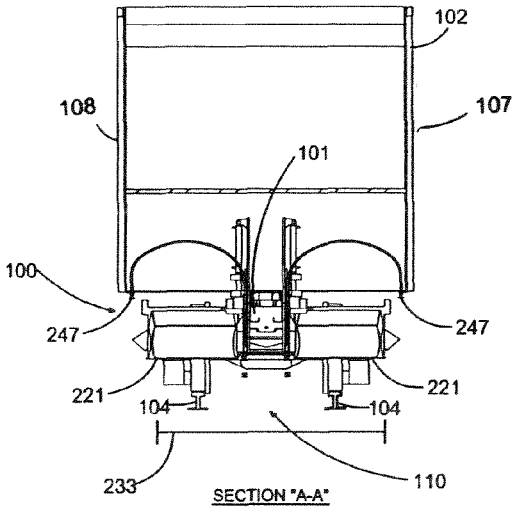

Railroad track or rail ballast 103 forms railbed upon which railroad rails and ties are laid, and is routinely distributed between and around the ties. The ballast 103 may be different types of material, but is usually crushed stone or rock, distributed from the underside 106 of the railcar 102 through the hopper releases 109. FIG. 1B shows the location of Section A-A, depicted in FIG. 1A, a front elevated view of the railcar 102.

Figure 2A:
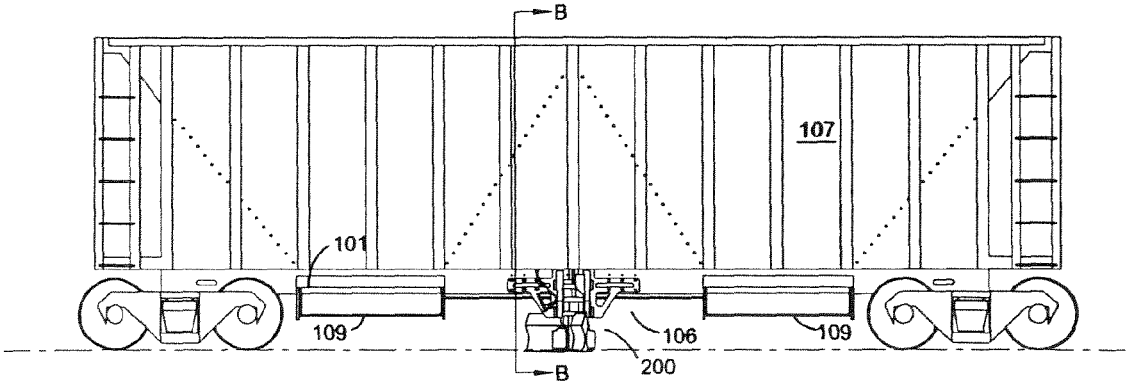
Figure 2B:
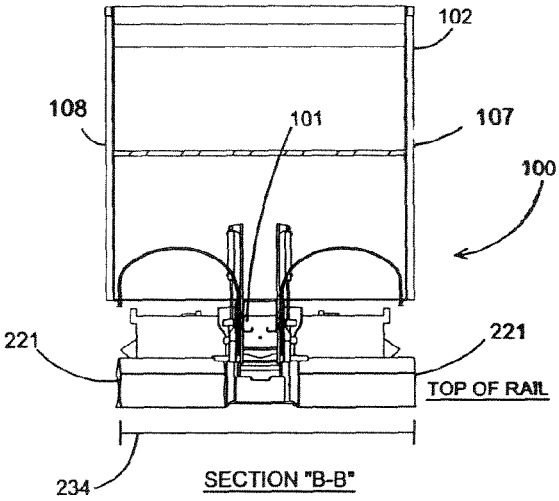

The pair of plow blades 221 FIGS. 1A and 1B are vertically and independently adaptable during contact against the pair of railroad rails 104 and have a transport mode span 233 and a separate deployed mode span 234 (in FIG. 2B). The pair of plow blades 221 to the single plow blade assembly 220 further, individually comprise, as shown in FIG. 7 A-C, a blade end cap 222, a blade bottom plate 224, a blade top plate 225, a blade base plate 226, a blade tube gusset 227, a rail wear plate 228, a pivot tube subassembly 229, a plow blade face plate 230, a blade inner channel 231, and a blade top shed plate 232. The rear wear plate 228 protects contact of each of the blades 221 with the rails 104. The pivot tube subassembly 229 raises the blades 221 and allows the blades 221 to pivot. The blade top shed plate 232 allows ballast 103 to fall off and away from the blades 221. The blade inner channel 231 attaches each of the pair of blades 221 to the pivot tube subassembly 229. The blade tube gusset 227 acts as a standard gusset to strengthen the plow blade assembly 220 and provide structural integrity to said assembly 220.

FIGS. 1 A and B illustrate the apparatus 100 in its transport mode, the railcar 102 moving without distributing ballast 103, and the pair of blades 221 having the transport mode span 233 as depicted. FIGS. 2 A and B illustrate the apparatus 100 in its deployed mode, the railcar 102 moving in either direction of travel 105 (shown in FIG. 1A) and distributing ballast 103, with the pair of plow blades 221 in the deployed mode span 234. FIG. 2A shows the location of Section B-B, depicted in the front view of FIG. 2B. The pair of plow blades 221 automatically and differentially change orientation when operatively and frictionally contacting the pair of railroad rails 104 according to the direction of travel 105 of the ballast railcar 102. As well, the pair of plow blades 221 increase in width or span to the deployed mode span 234 during their deployment and decrease to the transport mode span 233 during their retraction and transport.

In an embodiment of the invention the apparatus is powered by a hydraulic system 250 (located in FIG. 5), and is designed to fill-in the crib 110 or area between the rails 104 is shown in FIG. 1B and move excess rock (the ballast 103) outside of the rails 104 to a required width, of at least 9 foot 6 inches. The hydraulic system 250 comprises: a pair of hydraulic cylinders 252 and cylinder guide arrangement 251, FIGS. 3, 5 and 6 as well as other hydraulic cylinder elements common to hydraulic cylinders found in the industry, such as a tank, pump, valves, fittings, fasteners and hoses. FIG. 10 is a schematic of the hydraulic system 250.

Figure 3:
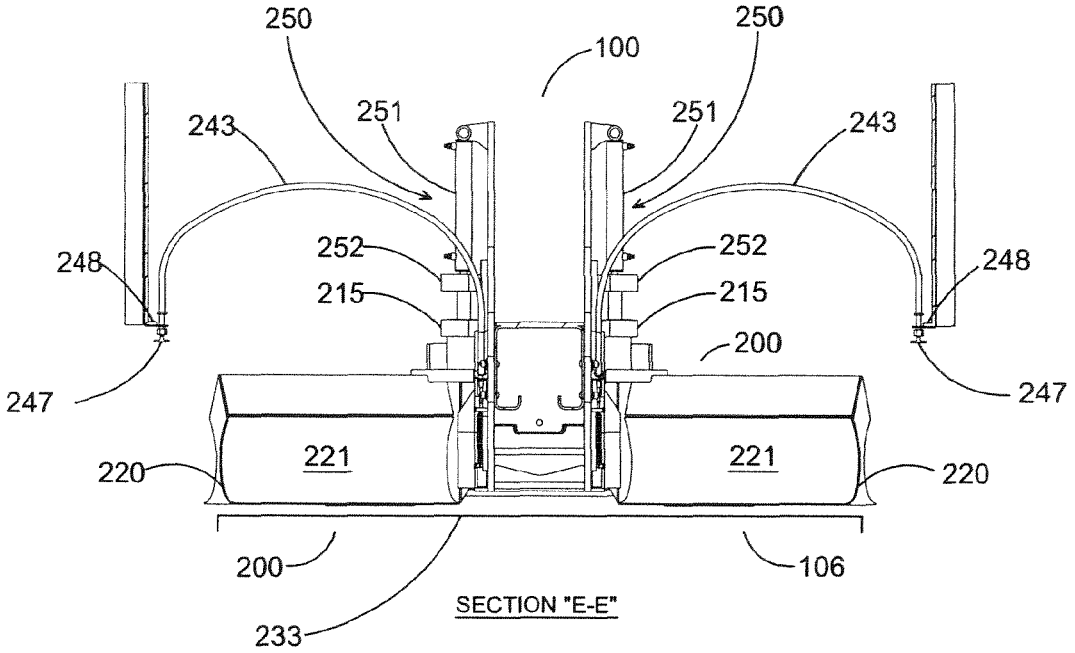
FIG. 3 is an elevated front view of an embodiment of the invention of Section E-E from FIG. 1A of the complete single plow blade assembly to the plow mechanism, partially hidden in FIG. 1A.

FIGS. 1-3 show further elements of an embodiment of the invention including the plow mechanism 200 of the apparatus 100 operatively attaching to a main bracket assembly 300 attaching to the center sill 101 of the railcar 102 at its middle underside 106. The plow mechanism 200 must allow for rails 104 cross-level (described below) and must maintain constant contact with the top of the rails 104 in its deployed mode span 234, distributing ballast 103. The plow mechanism 200 further comprises: a spring box assembly mechanism 210, shown in FIGS. 5 and 6, and FIGS. 8A and B, operating a single plow blade assembly 220, which comprises the pair of articulating and independently movable plow blades 221.

Shown in FIGS. 1, 2 and 3, the blades 221, elements of this invention, are often referred to as "wings", attached to the spring box assembly mechanism 210 in a fashion that allows each of the blades 221 to pivot back away from the direction of travel 105 and operate at an efficient angle, such as 40 degrees, back from perpendicular to the direction of travel 105. Returning to FIGS. 1-2, the blades 221 will automatically position themselves by friction with the rails 104 and the force of ballast 103 that is being plowed off. Only a single plow blade assembly 220 per railcar 102, in an embodiment of the invention, is necessary to screet ballast 103 in either direction of travel 105. The blades pivot themselves in the direction to pivotally direct the ballast rock away from the center of the rail crib 110, the area between the rails 104. To accomplish this, the pair of plow blades 221 have independent, articulating action, whereby each of the pair of blades 221 can move in the direction of travel 105, moving side-to-side, necessary for the way the ballast 103 is stockpiled and the direction of travel 105 the railcar 102 is moving. The blades 221 articulate or pivot in a diagonal position in response to the direction of travel 105 of the railcar 102, yielding to the resistant of the ballast 103. The articulating blades 221 move the ballast 103 away from crib 110 (shown in FIG. 1B) of the rails 104 due to the diagonal, pivoted position of the blades 221. When the railcar 102 reverses the direction of travel 105, the blades 221 again articulate or pivot in a diagonal position in frictional response to the new direction of travel 105 of the rail car 102, yielding to the resistance of the ballast 103. Therefore, the direction or orientation of the entire railcar 102 train does not have to change in order to effectively plow the ballast 103.

Figure 5:
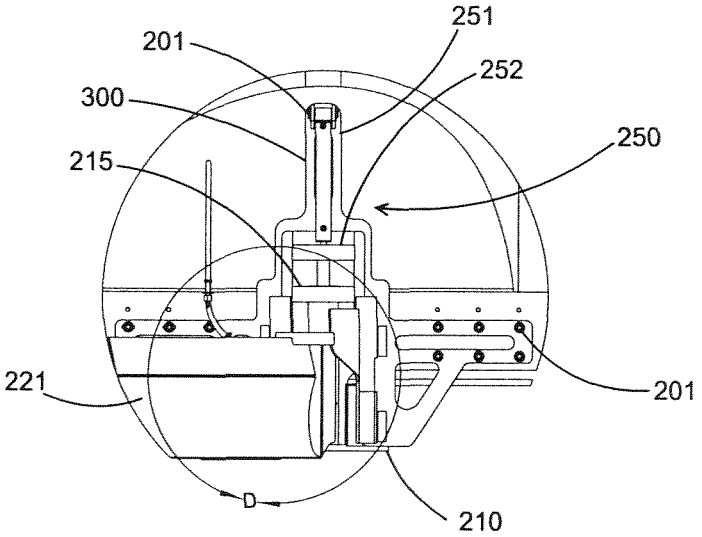
FIG. 5 is a blow-up view Detail "C" from FIG. 1A of the main bracket assembly and the spring box assembly mechanism with a view of one-half of the single plow blade assembly, in an embodiment of the invention.
Figure 6:
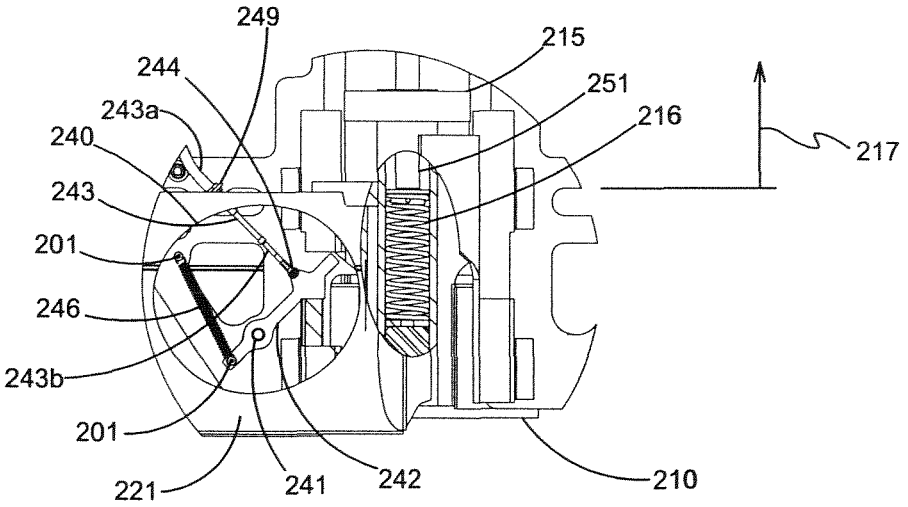
FIG. 6 is a blow-up, cutaway view, Detail "D" from FIG. 5, of the spring box assembly mechanism and the safety locking latch mechanism of an embodiment of the invention.
Figure 8B:
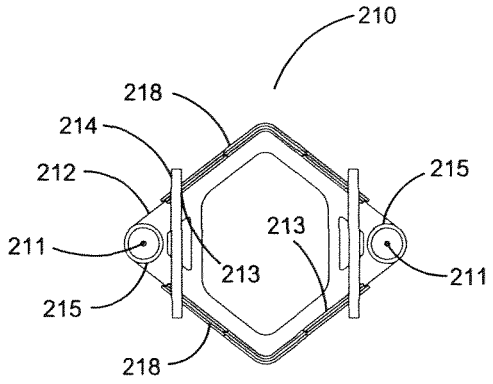

The spring box assembly mechanism 210, shown in FIGS. 5 and 6 and in detail in FIGS. 8 A and B, comprises: a spring-loaded safety locking latch mechanism 240 automatically engaging a spring box side plate 214 when the plow mechanism 200 is vertically retracted during the ballast railcar 102 relocating along the pair of railroad rails 104, and the pivot tube subassembly 229 housing a pressure controlling float spring 216. The spring box assembly 210 provides the mechanism that allows the articulating blades 221 of the plow mechanism 200 to be lifted and lowered as well as providing a pair of pivot points 211 on which the blades 221 are allowed to swing back opposite the direction of travel 105 of the ballast railcar 102, to move excess ballast 103 away from the center of the railroad rails 104.

In an embodiment of the present invention, the main bracket assembly 300, spring box assembly mechanism 210, hydraulic system 250 and safety locking latch mechanism 240, as well as other elements of the apparatus 100, are attached to the plow mechanism 200 by the plurality of fastening means 201 selected from a group comprising: shoulder bolts, cap screws, cylinder pins, clevis pins, cotter pins, cross braces, huck bolts, huck collars, welds and flat washers. Other fittings known in the industry may be used as fastening means 201. The apparatus 100 is constructed of rigid, durable metallic products known in the industry.

As shown in FIGS. 6 and 8, the spring box assembly mechanism 210 further comprises: a spring box bottom plate 212, a spring box reinforcement plate 213, a spring box wear plate 218 and the spring box side plate 214. The spring box reinforcement plate 213 reinforces the spring box bottom plate 212 and the spring box side plate 214. The spring box wear plate 218 is in contact with the ballast 103 and provides the apparatus 100 with wear protection against the abrasion of the ballast 103 during continued operation of the apparatus 100.

The spring box assembly mechanism 210 vertically deploys and retracts the pair of plow blades 221, and the pivot point 211 allows the pair of plow blades 221 to swingingly and obliquely orient to the direction of travel 105 of the railcar 102. Shown in FIGS. 6 and 8, the spring box assembly mechanism 210 further comprises the spring-loaded safety locking latch mechanism 240, which automatically engages the spring box side plate 214 when the plow mechanism 200 is vertically retracted during the period when the ballast railcar 102 is relocating along the pair of railroad rails 104, and the pivot tube subassembly 229, housing the pressure controlling float spring 216. The spring 216 in the spring box assembly mechanism 210 (in FIG. 6) enables the apparatus 100 to make the vertical retraction and deployment of the plow mechanism 200.

Depicted in FIGS. 4A and 4B, and 9A, 9B, and 9C, the main bracket assembly 300 comprises: a mainframe side plate 301, a pair of inner guide bottoms 302 and opposing pair of inner guide tops 303, a pair of outer guides 304, a pair of blade stop plates 306, a pair of blade swing plates 307, a pair of reinforcement plates 309, an inner cable mounting plate 310, a pair of main frame blade swing stops 311, and a pair of gusset plates 312. These elements of the main bracket assembly 300 govern the functioning latitudes of other elements of the apparatus 100. The pair of outer ides 304 to the main bracket assembly 300 guides the spring box assembly plate 214. The pair of blade stop plates 306 limits span of each of the pair of blades 221. The pair of blade swing plates 307 narrows the blade span. The inner cable mounting plate 310 attaches a pair of cable assemblies 243 to the pair of safety locks 242, allowing the operator to release the locks 242 in order to deploy the single plow blade assembly 220. The pair of main frame blade swing stops 311 keeps the pair of blades 221 from folding up or in when deployed; and the pair of gusset plates 312 strengthen the main bracket assembly 300.

The parallel rails 104 to any railroad track are not continually at the same level or elevation to each other at any particular point, and may be in unequal elevation, or cross-level, at a particular location along a railroad track. Shown in FIGS. 1 and 2, the single plow blade assembly 220 of an embodiment of the invention is attached to the plow mechanism 200 so that each of the blades 221 will move vertically, independently of each other to allow for cross level difference between the blade assembly 220. Each of the blades 221 is mounted so that it will adjust in a vertical direction to any vertical movement 217, depicted in FIG. 6, and continue to maintains contact with the top of the rails 104, shown in FIGS. 1A and B.

Critical to any functioning rail car ballast plow in the U.S. is operation within the railroad standard "AAR Plate C envelope", as established by the Association of American Railroads (AAR), which maintains and enforces North American railroad interchange rules, mechanical standards and component specifications. The bi-directional plow of the invention when deployed (deployed mode span 234) in the down position may be 9'6" wide, yet when it is in the up position (transport mode span 233) for transport may be only 8'4½", allowing it to fit in the AAR Plate C envelope, pursuant to the AAR Manual of Standards and Recommended Practices, adopted 1963, revised 1983, 1988 and 1991. Other inventions in the prior art have a fixed plow width, by which they must operate in the ballast plowing industry.

As shown in FIGS. 3, 5, and 6, the hydraulic system 250 is attached to the plow mechanism 200 and governs any vertical movement 217 of the spring box assembly mechanism 210, raising the plow mechanism 200 during transport. The hydraulic system 250 compresses the float spring 216 (in FIG. 6), absorbing the vertical movement 217, and maintaining the pair of plow blades 221 in contact with the pair of railroad rails 104, when deployed (in FIGS. 2A and B). This action enables the hydraulic system 250 to shut off, not needing to run constantly to provide pressure, while the blades 221 maintain down pressure with the rails 104.

A pivot tube retainer 215 (shown in FIGS. 3, 6, 8A and 8B) within the spring box assembly mechanism 210 is designed to house the pressure controlling float spring 216 that is compressed to a given position and held by the railcar's 102 hydraulic system 250. The hydraulic system 250 further comprises: a pair of hydraulic cylinders 251 and cylinder guide arrangement 252, as found in FIG. 5. The cylinder guide arrangement 252 acts to guide the deployment and retraction of the pair of plow blades 221, in conjunction with the actions of the hydraulic cylinders 251. In an embodiment of the invention, the hydraulic system 250 further comprises a flow divider 253 engaging the pair of hydraulic cylinders 251 and the cylinder guide arrangement 252, a directional control valve 254, and a pair of load check valves 255, within a valve manifold platform 351, shown in the schematic of FIG. 10. The valve manifold platform 351 engages and regulates the pair of hydraulic cylinders 251 and the cylinder guide arrangement 252. The schematic of FIG. 10 depicts those portions of the hydraulic system 250 which control the pair of plows 221 and are, therefore, elements of an embodiment of the invention apparatus 100, as well as those portions of the pair of hydraulic cylinders 251, such as the pump, tank (T), pressure indicators (P), reservoir, etc., set forth in a legend to the schematic, which constitute parts of the hydraulic system known in the industry. The flow divider 253 allows the cylinders 251 to retract the pair of plow blades 221 at the same rate, by allowing an equal amount of oil to be directed to each plow pair of hydraulic cylinders 251, to enable the plows 221 to be raised and lowered equivalently.

The flow divider 253, along with the directional control valve 254, is part of the hydraulic system 250 to an embodiment of the invention, as shown in the schematic of FIG. 10. The hydraulic system 250 incorporates, as well, a pair of load check valves 255, which together with the directional control valve 254 allow the pair of hydraulic cylinders 251 to maintain its vertical position, regardless of forces from below or above, so that the weight of the railcar 102 will not cause the spring box assembly mechanism 210 to move. One of the load check valves 255 holds the pair of cylinders 250 in an extended position, the other of the load check valves holds the pair of cylinders 250 in a retracted position. The float spring 216 (in FIG. 6) allows the plow blade assembly 220 to "float", thus allowing for the vertical movement 217 of the plow blades 221, and the assembly 220 to maintain constant contact with top of the rails. Thus, the pair of hydraulic cylinders 251 are used to deploy and retract the plow blades 221. The cylinder guide arrangement 252 is attached to the hydraulic cylinders 251, guiding and assisting the plow mechanism 200 to retract the plow blade assembly 220 and compress the float spring 216 when deploying the plow blade assembly 220.

The schematic of FIG. 10, in an embodiment of the invention, outlines the hydraulic cylinders 251 portion of the apparatus 100 as operated by a plurality of electrically powered controls 350. Depicted by FIG. 10 is a valve manifold platform 351 for operations of the hydraulic system 250 whereby the pair of load check valves 255 together with the directional control valve 254 allow the pair of hydraulic cylinders 251 to maintain vertical position. The valve manifold platform 351 provides an iso-DO3 platform, of standard industry size, for the stacking of the valves 254 and 255 and the flow divider 253.

The hydraulic system 250 to the apparatus 100 is powered by an at least one power means selected from a group comprising: electricity, compressed air, and an internal combustion engine.

The directional control valve 254 lets oil go to the flow divider 253 when the directional control valve 254 receives pressure. A redundant system of a plurality of electrically powered controls 350, known in industry, may be provided in another embodiment of the invention in the apparatus 100 to control raising and lowering the pair of plow blades 221, on either side 106 and 108 of the railcar 102. The flow divider 253, in turn, distributes the oil evenly to the pair of hydraulic cylinders 251.

Shown in FIG. 6, the safety locking latch mechanism 240 further comprises: a safety lock crossbar 241 attaching to the pair of safety locks 242, the pair of cable assemblies 243, a pair of rod ends 244, and a pair of extension springs 246. The safety lock crossbar 241 attaches to the safety locks 242. The cable assemblies 243 are sealed, push-pull control cables, as are standard in the industry, and each comprise: (1) an outer sheath 243*a* attaching to the inner cable mounting plate 310 at a sheath attachment point 249, shown in FIGS. 6 and 9A, and to the opposite safety lock 242, control cable handles 247 at a cable attachment point 248 (FIG. 3); (2) and an inner cable 243*b* attaching to the cable handle 247 (FIG. 3) and the opposite safety lock 242, as shown in FIGS. 3 and 6.

As noted above, the pair of cable assemblies 243, shown in FIG. 6, goes into the inner cable mounting plate 310, shown in FIG. 9A. The pair of rod ends 244 attaches the pair of cable assemblies 243 to the safety locks 242, whereby the pair of cable assemblies 243 operates the safety locking latch mechanism 240. The safety locks 242 pivot or rotate so that the extension springs 246 return the safety locks 242 and the plow blades 221 to the transport position, thereby locking the plow blades 221, preventing the plow blades 221 from descending when the cable assemblies 243 are released.

The pair of extension springs 246, shown in FIG. 6, is in compressional cooperation with the latch mechanism 204, returning the safety locks 242 to latching position when required by the operator. The safety lock 242 to the safety locking latch mechanism 240 are releaseable from either the first side 107 or the second side 108 of the ballast railcar 102. When the operator pulls one of the cable handles 247, the pair of safety locks 242 are rotated on the safety lock cross bar 241 out of locking position, allowing the pair of plow blades 221 to descent.

Shown in FIG. 6, the safety locking latch mechanism 240 is spring loaded with the pair of extension springs 246 so that it will automatically engage when the plow blades 221 are lifted to the travel, transport position, disengaging the plow mechanism to allow the ballast railcar 102 to re-locate down the railroad track. The safety lock 242 can be released from either side of the ballast railcar 102 by a control handle 247 switch located on each side 107 and 108 of the ballast railcar 102.

The plow mechanism 200 can be activated and operated from either side 107 or 108 of the ballast railcar 102 and does not require operators to be located simultaneously on each side of the railcar 102. The ballast railcar 102 is then powered, or the power supply to the plow mechanism 200 is activated by a plurality of electrically powered controls 350 operating the hydraulic system 250. The plow blades 221 are raised to remove weight from the safety locking latch mechanism 200. Once the safety locking latch mechanism 200 is moved to the release position, the electrically powered controls 350 are activated to the "down" position to move the plow blades 221 in contact with the rails 104. Once the plow blades 221 contact the rails 104, the controls 358 continue to activate in the down position so as to compress the float spring 216 to the maximum compressed length, to maintain plow blades' 221 contact with the rails 104.

With the plow blades 221 in the operating position, the train hauling the ballast railcar 102, depicted in FIGS. 1-2, may move down the rails 104 dumping ballast 103 in front of the pair of plow blades 221. The railcar ballast distributing apparatus 100 distributes and levels the ballast 103 in front of and between the railroad rails 104 (in the crib 110) as the ballast railcar 102 moves in the direction of travel 105 along the railroad rails 104.

When there is no longer ballast 103 in front of the plow blades 221, the plow blades 221 can be raised. To raise the plow blades 221, the operator simply activates controls 350 to the raised position. The plow blades 221 will raise up and fold into the travel position, the transport mode span 233, depicted in FIGS. 1 A and B. When the plow blades 221 are raised for transport, the plow blades 221 automatically fold in to the transport mode span 233, which can be the 8' 4½" dimension required by AAR standards above. When the plow blades 221 reach the top of their lift stroke, the operator visually inspects whether the safety locking latch mechanism 240 has engaged. The control handle 247 can be activated by the operator to the down position to apply some pressure on the safety locking latch mechanism 240.

The invention therefore is directed to a ballast plow for distributing and leveling ballast 103 that has been dumped in front of it and between the rails 104. The apparatus 100 employs a pair of plow blades 221 that maintain contact with the rails 104 as the railcar 102 moves along the rails 104 or to plow or otherwise level the ballast 103. The apparatus 100 functions when the railcar 102 is moving in either direction (direction of travel 105) due to the use of a single blade plow assembly 220 having a pair of articulating blades 221 with a blade width that increases upon deployment (deployed mode span 234) and decreases when retracted (transport mode span 233). The articulating blades 221 are adapted to automatically change direction with the direction of the railcar 102 (direction of travel 105) since the blades 221 are guided against the rails 104 due to frictional contact.

The apparatus 100 further comprises a main bracket assembly 200 to attach the plow mechanism 200 to the center sill 101 of a railway car (ballast railcar 102). The spring box assembly mechanism 210 enables the blades 221 to be raised and lowered and about which to pivot and swing rearwardly relative to the direction of railcar travel 105. The plow blades 221 or pair of wings, are attached to the spring box assembly mechanism 210 and move independent of each other. A pivot tube assembly 229 houses a float spring 216 that vertically compresses so as to enable the plow mechanism 200 to maintain constant pressure against the rails 104. A safety locking latch mechanism 240 is provided to the sides of the apparatus 100.

Having thus described in detail a preferred selection of embodiments of the present invention, it is to be appreciated, and will be apparent to those skilled in the art, that many physical changes could be made in the apparatus without altering the invention, or the concepts and principles embodied therein. Unless otherwise specifically stated, the terms and expressions have been used herein as terms of description and not terms of limitation, and are not intended to exclude any equivalents of features shown and described or portions thereof. Various changes can, of course, be made to the preferred embodiment without departing from the spirit and scope of the present invention. The present invention and apparatus, therefore, should not be restricted, except in the following claims and their equivalents.

I claim:

1. A railcar ballast distributing apparatus, comprising:

(a) a railcar comprising: a first side, a second side, a middle underside, at least one hopper ballast release and a center sill;

(b) a plow mechanism operatively attaching to a main bracket assembly attaching to the center sill of the middle underside, and being powered by a hydraulic system;

(c) the ballast railcar traveling in a direction of travel on a pair of railroad rails and containing ballast;

(d) the plow mechanism comprising: a spring box assembly mechanism operating a single plow blade assembly comprising: a pair of articulating and independently movable plow blades;

(e) the pair of plow blades being vertically and independently adaptable during contact against the pair of railroad rails and having a transport mode span and a separate deployed mode span;

(f) the spring box assembly mechanism vertically deploying and retracting the pair of plow blades, and providing a pair of pivot points allowing the pair of plow blades to swingingly and obliquely orient to the direction of travel of the railcar;

(g) the pair of plow blades automatically and differentially changing orientation when operatively and frictionally contacting the pair of railroad rails according to the direction of travel of the ballast railcar;

(h) the pair of plow blades increasing to the deployed mode span during deployment of the pair of plow blades and decreasing to the transport mode span during retraction of the pair of plow blades;

(i) the spring box assembly mechanism comprising: a spring-loaded safety locking latch mechanism automatically engaging a spring box side plate when the plow mechanism is vertically retracted during the ballast railcar relocating along the pair of railroad rails, and a pivot tube subassembly housing a pressure controlling float spring;

(j) the hydraulic system attaching to the plow mechanism and governing any vertical movement of the spring box assembly mechanism;

(k) the hydraulic system compressing the float spring, absorbing the vertical movement, and maintaining the pair of plow blades in frictional contact with the pair of railroad rails; and (l) whereby the railcar ballast distributing apparatus distributes and levels the ballast in front of and between the railroad rails as the ballast railcar moves in the direction of travel along the railroad rails.

2. The apparatus according to claim 1, wherein the pair of plow blades to the single plow blade assembly further, individually comprise: a blade end cap, a blade bottom plate, a blade top plate, a blade base plate, a blade tube gusset, a rail wear plate, the pivot tube subassembly, a plow blade face plate, a blade inner channel, and a blade top shed plate.

3. The apparatus according to claim 1, wherein the main bracket assembly comprises: a mainframe side plate, a pair of inner guide bottoms and opposing pair of inner guide tops, a pair of outer guides, a pair of blade stop plates, a pair of blade swing plates, a pair of reinforcement plates, an inner cable mounting plate, and a pair of main frame blade swing stops.

4. The apparatus according to claim 1, the spring box assembly mechanism further comprising: a spring box bottom plate, a spring box reinforcement plate, a spring box wear plate and the spring box side plate.

5. The apparatus according to claim 1 wherein the safety locking latch mechanism further comprises:

(a) a safety lock crossbar attaching to a pair of safety locks, a pair of cable assemblies, a pair of rod ends, and a pair of extension springs; and (b) the cable assemblies individually comprising: an outer sheath attaching to the inner cable mounting plate at a sheath attachment point and to an opposite control handle at a cable attachment point and an inner cable attaching to the control handle and the opposite safety lock.

6. The apparatus according to claim 1 wherein the hydraulic system comprises: a pair of hydraulic cylinders and cylinder guide arrangement.

7. The apparatus according to claim 1 whereby the safety lock latch mechanism further comprises: the safety lock being releaseable from either the first side or the second side of the ballast railcar.

8. The apparatus according to claim 1 wherein the main bracket assembly, spring box assembly mechanism, hydraulic system and safety locking latch mechanism are attached to the plow mechanism by a plurality of fastening means selected from a group comprising: shoulder bolts, cap screws, cylinder pins, clevis pins, cotter pins, cross braces, huck bolts, huck collars, welds and flat washers.

9. The apparatus according to claim 1 wherein the hydraulic system further comprises a flow divider, directional control valve, and a pair of load check valves within a valve manifold platform; the valve manifold platform engaging and regulating the pair of hydraulic cylinders and the cylinder guide arrangement.

10. The hydraulic system according to claim 9, wherein the cylinder guide arrangement attaching to the hydraulic cylinders and guiding and assisting the plow mechanism to retract the plow blade assembly and compress the float spring when deploying the plow blade assembly.

11. The hydraulic system according to claim 9, wherein the hydraulic system further comprises: a plurality of electrically powered controls on either side and of the railcar controlling the pair of plow blades and the plow mechanism from either the first or the second side of the railcar.

12. The apparatus according to claim 1, wherein the hydraulic system is powered by an at least one power means selected from a group comprising: electricity, compressed air, and internal combustion engine.

* * * * *